United States Patent [19]

Fujisaki et al.

[11] 3,974,550

[45] Aug. 17, 1976

[54] SLIDE FASTENER STRINGER

[75] Inventors: Yoshinori Fujisaki, Kurobe; Yoshio Matsuda, Nyuzen; Yoshitoki Tsubokawa, Kurobe, all of Japan

[73] Assignee: Yoshida Kogyo Kabushiki Kaisha, Japan

[22] Filed: Sept. 10, 1975

[21] Appl. No.: 612,108

[30] Foreign Application Priority Data

Sept. 25, 1974 Japan ..... 49-116205[U]

[52] U.S. Cl. ..... 24/205.1 C; 24/205.16 C; 24/205.13 C; 66/195

[51] Int. Cl.[2] ..... A44B 19/12

[58] Field of Search ..... 24/205.16 C, 205.1 C, 24/205.13 C

[56] References Cited

UNITED STATES PATENTS 3,820,202 6/1974 Takamatsu ..... 24/205.1 C 3,849,842 11/1974 Yoshida ..... 24/205.1 C

*Primary Examiner*—Bernard A. Gelak

*Attorney, Agent, or Firm*—Bucknam and Archer

[57] ABSTRACT

A stringer for a slide fastener is provided with a warp-knit tape having alternate wales and interwale grooves and a row of fastener elements secured thereto. The element has a recess in one of its legs for receiving a larger wale of the tape. The interwale grooves located on opposite sides of said larger wale are adapted to receive therethrough sewing threads and are widened such that the inner surfaces of the grooves are urged into intimate contact with said one leg under the influence of sewing pressure applied when sewing the element to the tape.

3 Claims, 4 Drawing Figures

SLIDE FASTENER STRINGER

BACKGROUND OF THE INVENTION

This invention relates to a slide fastener and more particularly to a fastener stringer carrying along one longitudinal edge thereof a row of interlocking fastener elements.

There are known slide fasteners having oppositely disposed stringer tapes, each of which tapes is warp-knitted with a multiplicity of longitudinal wales projecting on one surface and is attached with a row of interlocking fastener elements having cut-out recesses in their leg portions for fitting engagement with the projecting wales of uniform height located at one longitudinal edge portion of the tape. By thus anchoring the wales of the tape into the recesses of the fastener elements, it is made possible to secure the fastener elements by sewing to the tape with sufficient stability the position of the elements to prevent the elements from moving out of position or otherwise becoming displaced relative to the tape. However, since the wales of the tape utilized for engagement with the recesses of the fastener elements were of uniform height at one longitudinal edge portion of the tape, it was necessary to provide a plurality of such cut-out recesses or indents in the leg portion of each fastener element corresponding to the number of wales disposed along the tape edge to which the row of fastener elements is to be secured. This has resulted in reduced mechanical strength of the fastener elements per se and hence in deformed or otherwise damaged elements after a relatively short period of service.

SUMMARY OF THE INVENTION

With the foregoing deficiencies of the prior art slide fasteners in view, it is the primary object of the present invention to provide an improved fastener stringer comprising a support tape of a warp-knit structure and a row of interlocking fastener elements which is secured to a longitudinal edge portion of the tape with greater stability and yet without sacrifice of the mechanical strength of the elements.

A more specific object of the invention is to provide a fastener stringer comprising a warp-knitted support tape having increased surface areas disposed in intimate engagement with the majority of the leg portion of each fastener element so as to provide a maximum tape to element contact stability against their relative displacement. Briefly stated, the present invention provides a fastener stringer interengageable by the action of a reciprocating slider with a mating stringer, which fastener stringer comprises a warp-knit fabric tape having alternate wales and interwale grooves on one surface and a row of interlocking fastener elements each having a recess or indent disposed for receiving a selected one of the wales adjacent one longitudinal edge portion of the tape, the interwale grooves located on opposite sides of said selected wale being adapted for the passage of sewing threads securing the fastener elements to the tape.

For a better understanding of the invention, reference is made to the accompanying drawing illustrating by way of example some preferred embodiments which the invention may assume in practice. Like reference characters are used to denote like or corresponding parts throughout the several views.

DESCRIPTION OF THE PREFERRED EMBODIMENTS

Figure 2:
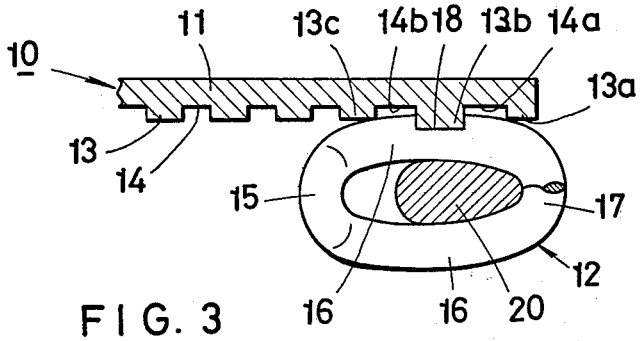
FIG. 2 is a transverse cross-sectional view of one of the pair of stringers of FIG. 1, but showing the fastener element simply mounted on and unsewn to the stringer tape.
Figure 4:
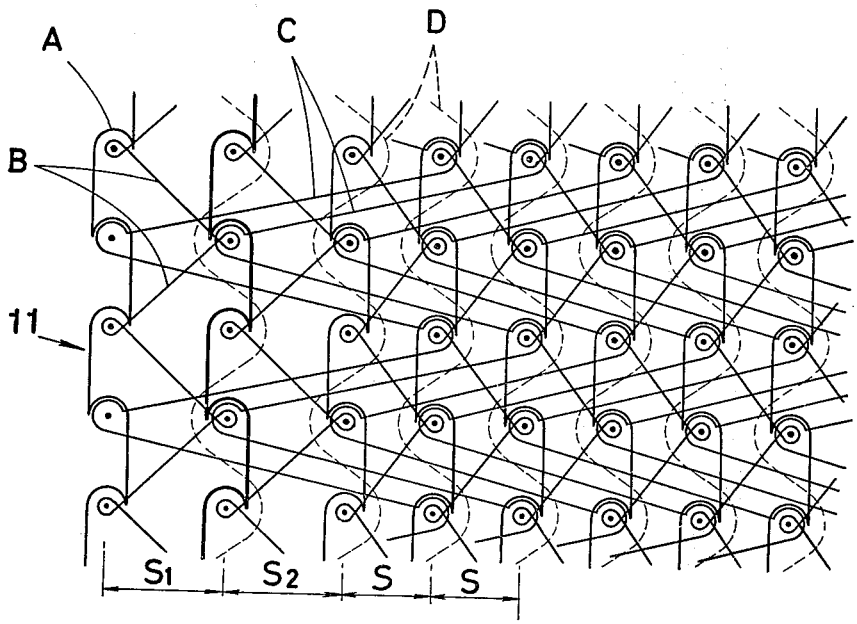
FIG. 4 is a diagram showing the construction of an example of warp-knit tape utilized for the purpose of the invention.

Referring now to the drawing and FIG. 2 in particular, there is shown one of a pair of fastener stringers generally designated 10 which comprises a warp-knit support tape 11 and a row of interlocking fastener elements 12 to be secured into position on one longitudinal edge portion of the tape 11. The support tape 11 is provided on one surface with alternate wales 13 and interwale grooves 14 extending longitudinally of the tape, while the other surface is rendered flat. A tape of this structure is formed preferably by a warp knitting process, a typical example of which tape is diagrammetically shown in FIG. 4. This warp-knitted tape is comprised of chain stitches A which form the wales 13, tricot stitches B in the lay of 1-2/1-0, stitches C in the lay of 0-1/4-3 and inlaid lapping threads D, with the interwale grooves 14 formed warpwise between adjacent wales 13. It is to be noted that there is employed a yarn of greater denier or a plurality of yarns held together for the second row of chain stitches or wale **13*b* neighbouring the first or innermost wale 13*a* disposed along an extremity of the longitudinal edge of the tape 11, the second wale 13*b* being thus rendered higher and wider than the remaining wales 13. It is also to be noted that the wale-to-wale spacing $S_1$, i.e. interwale groove 14*a* between the intermost wale 13*a* and the second wale 13*b* and the spacing $S_2$ or interwale groove 14*b* between the second wale 13*b* and adjacent third wale 13*c* are greater than any remaining interwale spacing S or interwale groove 14 of the tape 11.**

Figure 1:
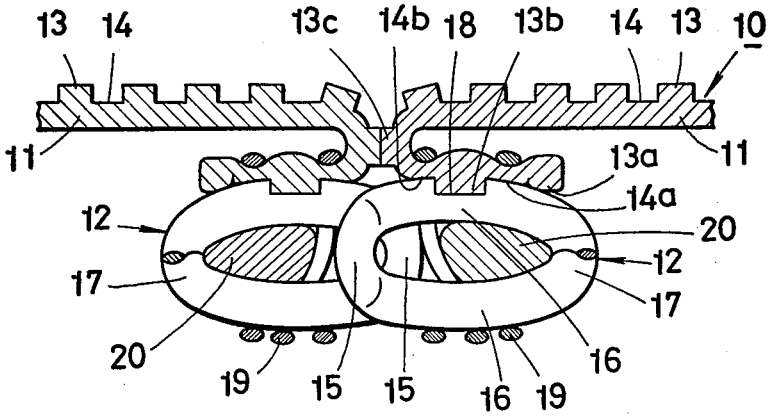
FIG. 1 is a transverse cross-sectional view of a pair of fastener stringers of the concealed or meshed type provided in accordance with the invention and shown coupled together.

The interlocking fastener element 12 is shown for purposes of illustration to be in the form of a helical coil having a coupling head 15, two legs 16 and connecting portions 17 merging into adjacent coils. The element 12 is provided in one of the two legs 16 with a recess or indent 18 dimensioned to fit with the second wale **13*b* of the tape 11, said second wale 13*b* being defined for the sake of convenience as "an anchoring wale" in the appended claims. The interwale grooves 14*a* and 14*b*, which are defined conveniently as "supporting interwale groove" in the appended claims, are adapted to receive therethrough sewing threads 19 which secure the element 12 to the respective tape 11 through the medium of a reinforcing core 20 inserted in the coil of the element 12 as shown in FIG. 1. An inspection of FIG. 1 shows that when sewing the element 12 to the tape 11, the supporting interwale grooves 14*a* and 14*b* are crushed under the influence of sewing pressure so that their inner surfaces are urged into intimate contact with the outer surface of the element leg 16 at which the recess 18 is located. At the same time, the innermost wale 13***a* is likewise brought into pressure engagement with the element legs 16 adjacent the connecting portions 17, while the second or anchoring wale 13*b* is firmly anchored in place within the recess 18 of the element 12. Thus, the area of contact between the element 12 and the tape 11 in the stringer 10 of the invention is considerably increased as compared to the prior art stringers, so that the element 12 can be retained stably in place against displacement relative to the tape 11 when subjected to stresses applied by a slider (not shown) or any severe external stresses. Furthermore, the provision of a single recess 18 per each coil element 12 maintains sufficient strength of the element 12 to keep the same from being deformed or otherwise damaged.

Figure 3:
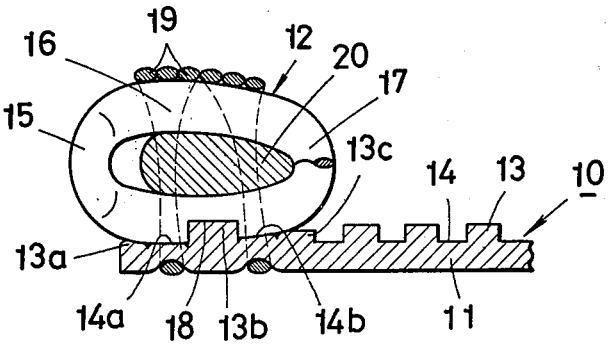
FIG. 3 is a transverse cross-sectional view of a fastener stringer of the ordinary, non-concealed type provided in accordance with the invention.

FIG. 3 shows simply for purposes of illustration another embodiment in which the principles of the invention are applied to an ordinary type of stringer as contrasted to the concealed type that has been advanced and in which the element 12 is mounted with its head 15 disposed adjacent to and slightly projecting beyond the inner longitudinal edge of the tape 11.

What is claimed is:

1. In a slide fastener stringer comprising a warp-knitted tape having longitudinally extending alternate wales and interwale grooves and a row of interlocking fastener elements each having an interlocking head and two legs and mounted on and along one longitudinal edge portion of said tape, the improvement wherein an anchoring wale neighbouring an innermost wale of the tape is greater in height and width than said innermost wale and is adapted for fitting engagement with a recess formed in one of the two legs of each element, and supporting interwale grooves located on opposite sides of said anchoring wale are greater in width than the remaining interwale grooves of the tape and are adapted for the passage of sewing threads therethrough, whereby the knit fabric of the tape including that of said anchoring wale, said innermost wale and said supporting interwale grooves is brought into pressure engagement intimately with said one leg of each element by the sewing threads into position on the tape.

2. The improvement as defined in claim 1 wherein said warp-knitted tape is comprised of chain stitches which form said wales, tricot stitches in the lay of 1-2/1-0, stitches in the lay of 0-1/4-3 and inlaid lapping threads.

3. The improvement as defined in claim 2 wherein said chain stitches which form said anchoring wale are formed by a bulky yarn or a plurality of knitting threads held together.

* * * * *